United States Patent [19]

Van de Pol

[11] Patent Number: 4,936,495

[45] Date of Patent: Jun. 26, 1990

[54] SHOULDER STRAP ATTACHMENT

[75] Inventor: Herbert D. Van de Pol, Riviera Beach, Fla.

[73] Assignee: Wenoka Seastyle, West Palm Beach, Fla.

[21] Appl. No.: 309,141

[22] Filed: Feb. 13, 1989

[51] Int. Cl.[5] ..... A45F 3/04; A45F 3/14

[52] U.S. Cl. ..... 224/209; 224/202; 224/257; 224/205; 224/259; 383/20; 112/440

[58] Field of Search ..... 224/153, 255, 257, 259, 224/205, 209, 202, 213, 214, 210, 211, 212, 215, 216; 190/124–127; 150/127–130; 112/440, 441, 417; 383/20

[56] References Cited

U.S. PATENT DOCUMENTS

| | | | |
|---|---|---|---|
| 995,458 | 6/1911 | Harriman | 224/214 |
| 1,397,161 | 11/1921 | Clemetson . | |
| 2,423,853 | 7/1947 | Ryan | 224/209 |
| 3,882,914 | 5/1975 | Strutz | 224/202 |
| 3,938,716 | 2/1976 | Jackson et al. | 224/153 |
| 4,082,208 | 4/1978 | Lane, Jr. | 224/209 |
| 4,089,447 | 5/1978 | Achmeteli | 224/214 |
| 4,662,549 | 5/1987 | Dean | 224/153 |

FOREIGN PATENT DOCUMENTS

| | | | |
|---|---|---|---|
| 158154 | 10/1985 | European Pat. Off. | 224/153 |
| 257142 | 3/1988 | European Pat. Off. | 224/213 |
| 2538146 | 3/1977 | Fed. Rep. of Germany | 224/209 |
| 0250606 | 9/1912 | German Democratic Rep. | 224/209 |
| 667195 | 9/1988 | Switzerland | 224/213 |
| 2197582 | 5/1988 | United Kingdom | 224/213 |

*Primary Examiner*—Henry J. Recla
*Assistant Examiner*—Keith Kupfeschmid
*Attorney, Agent, or Firm*—Wolf, Greenfield & Sacks

[57] ABSTRACT

A device for attaching a shoulder strap to a fabric wall of a backpack comprising a pair of flexible reinforcing fabric members positioned orthogonally to each other and on either side of one end of the shoulder strap and further including stitches implemented in a box stitch pattern which secure one of the fabric members to the strap and additional stitches securing the strap, both fabric members and the fabric wall of the backpack together.

8 Claims, 2 Drawing Sheets

SHOULDER STRAP ATTACHMENT

FIELD OF THE INVENTION

This invention relates to backpacks, bags and other carrying devices made of fabric. In particular, the present invention relates to a means for securing a shoulder strap to a fabric wall of backpack or bag.

BACKGROUND OF THE INVENTION

Backpacks, knapsacks and other carrying devices have experienced an increase in popularity in recent years. One reason for this popularity is that these bags can be manufactured of fabric that is durable and strong yet lightweight and easy to carry especially when the bag or pack is not full. Another reason for the increased popularity of these devices is inclusion of shoulder straps which allow the pack or bag to be carried on the shoulders of the user instead of dangling from the arms. Particularly in backpacks, shoulder straps enable the weight of the loaded pack to be distributed even over the upper torso of the carrier, whereas a handle concentrates the weight of the loaded pack in the arms of the carrier quickly causing fatigue. Furthermore, when a handle is used to carry a loaded bag, a momentum builds up in the dangling bag much like a pendulum motion making it difficult for the user to maintain the bag in a convenient position while walking. Hence the increased popularity of shoulder straps in backpack type devices.

Although the weight of a loaded pack is distributed evenly over the upper torso with shoulder straps, large amounts of stress are exerted at the point where the shoulder straps are connected to the backpack. Most backpacks are made of cloth or fabric as are the shoulder straps. These cloth on cloth joints where the shoulder strap attaches to the backpack wall prove to be one of the weakest parts of most backpacks and often cause a premature end to the useful life of a backpack.

Attempts to reinforce the shoulder strap attachments have yielded a variety of devices including metal rings, fabric eyelets and leather reinforcements, however, most of these attempts have proven unsuccessful, impractical or too expensive to manufacture. Hence the shoulder strap attachment continues to be one of the most vulnerable parts of a backpack.

It is therefore an object of the present invention to provide a means for securing a shoulder strap to a fabric wall of a backpack that creates a strong, durable joint between the shoulder strap and the fabric wall and is thereby capable of withstanding extended wear and tear and abuse.

It is a further object of the present invention to provide a means for attaching a shoulder strap to the fabric wall of a backpack that is economical and easy to implement.

SUMMARY OF THE INVENTION

According to the present invention, an attachment means is provided for securing a shoulder strap to a fabric wall of a backpack. The attachment means includes a pair of pieces of nylon webbing arranged perpendicularly. The first piece of nylon webbing is positioned horizontally across the end of the shoulder strap. The second piece of nylon webbing is positioned parallel to and intermediate the shoulder strap end and the backpack fabric wall. The attachment means further includes stitching for attaching the second piece of nylon webbing to the shoulder strap end and additional stitching extending through the fabric wall, the first nylon webbing piece, the shoulder strap end, and the second nylon webbing piece thereby securing these elements together, and forming a strong attachment joint between the shoulder strap and the backpack.

DETAILED DESCRIPTION OF THE INVENTION

Figure 1:
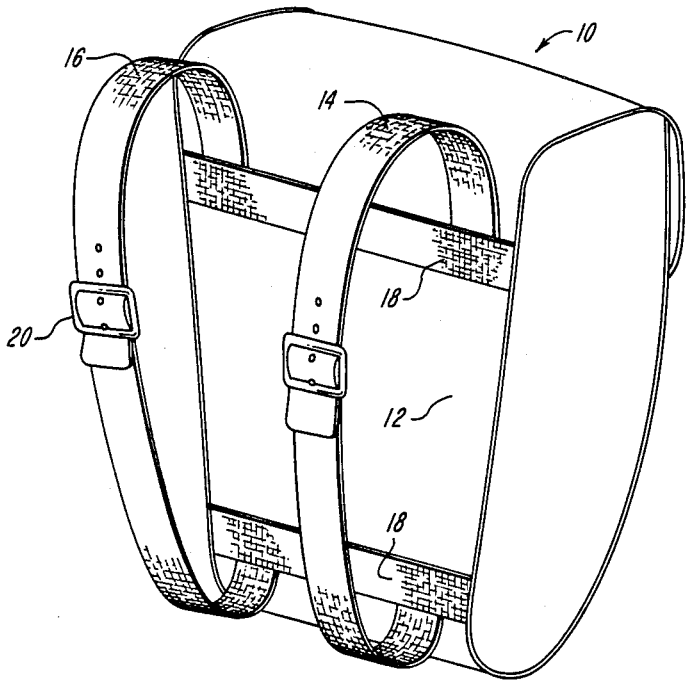
FIG. 1 is a perspective view of a backpack with shoulder strap attachments.

Referring now to the drawings, in particular FIG. 1, a backpack 10 includes a fabric wall 12 and shoulder straps 14 and 16 positioned vertically against the fabric wall 12. In the preferred embodiment of the present invention, shoulder straps 14 and 16 are fixed parallel to one another and are separated by a gap of several inches. Also in the preferred embodiment, shoulder straps 14 and 16 are made of a durable material and have a polyurethane foam center 32 which extends the length of the strap, except for several inches at either end.

In the preferred form of the invention, a single stitching 34 extends longitudinally on each strap 14 to secure the fabric of the strap 28 and 30 and the polyurethane foam center 32 into a single integrated strap.

Figure 2:
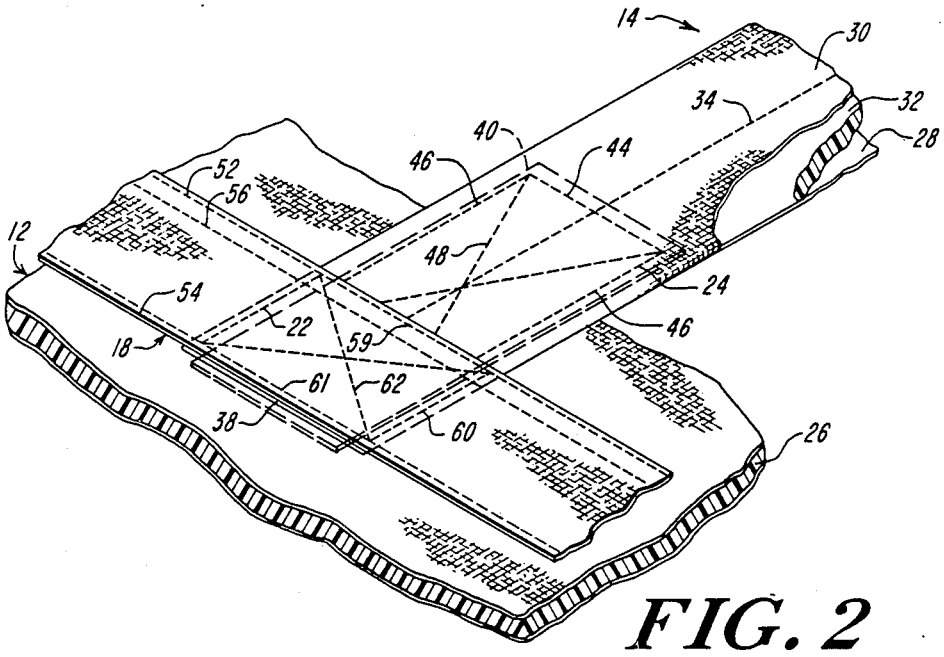
FIG. 2 is an exploded perspective view of the elements comprising the present invention.
Figure 3:
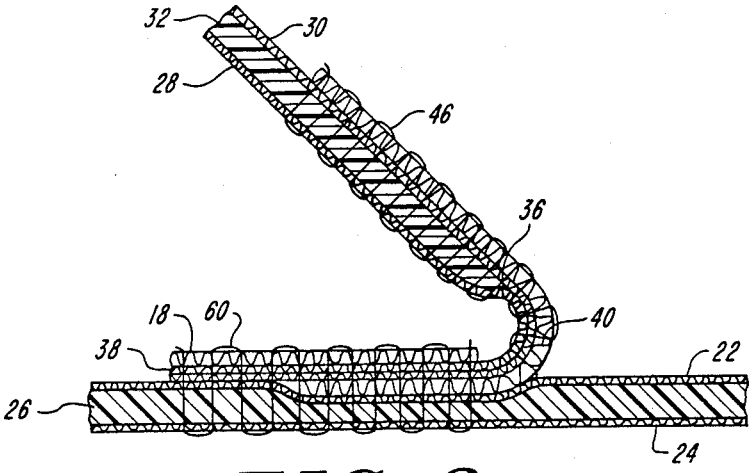
FIG. 3 is an expanded side view of a shoulder strap attached to the fabric wall of a backpack as implemented the present invention.
Figure 4:
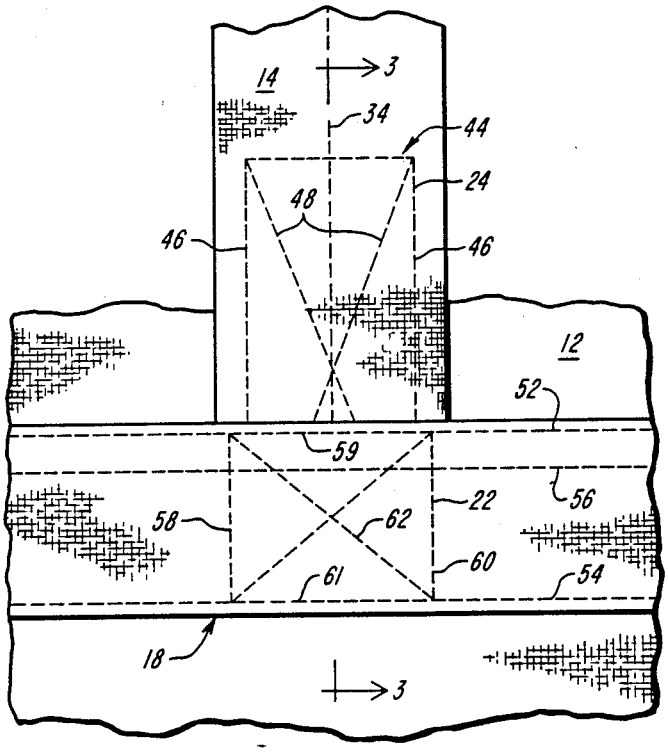
FIG. 4 is a top view of the shoulder strap as attached to the backpack illustrating the positions and shapes of the box-stitch patterns used to secure the elements of the invention together.

Referring now to FIG. 2, a pair of flexible reinforcing fabric members 18 and 40, embrace strap 38 of shoulder strap 14 in an orthogonal relation to one another. Fabric member 40 is aligned longitudinally with strap end 38 and lies intermediate strap 14 and fabric wall 12. Fabric member 18 is aligned horizontally across strap end 38 and perpendicular fabric member 40. As illustrated in FIG. 3, fabric member 40 in the preferred embodiment, the fabric member 18 covers a portion of stitches 46 and 44 and is stitched by a plurality of rows of stitches 52 and 54, preferably extending the length of and close to the side edges of the fabric member 18. If desired, a third lengthwise extending row of stitches 56 may be used, and strap end 38 are positioned intermediate fabric member 18 and fabric wall 12.

In the preferred embodiment of the present invention, stitching means are provided to secure the elements of the present invention together. A first stitching means is used to attach fabric member 40 to shoulder strap end 38. This first stitching means includes a pair of parallel stitches 46 aligned longitudinally along fabric member 40 and strap end 38 and a second pair of parallel stitches 44 aligned transversely across the end of fabric member 40 and strap end 38 thereby forming a box-stitch pattern 24 with parallel stitches 46. A further pair of stitches 48 extends diagonally across box stitch 24 connecting the corners. Box stitch pattern 24 extends through shoulder strap end 38 and fabric member 40 thereby securing these elements together. In a similar manner, a second stitching means is provided to secure fabric member 40 and strap end 38 between fabric member 18 and fabric wall 12. This second stitching means consists of a pair of parallel stitches 58 and 60 longitudinally aligned with strap end 38 and a second pair of parallel stitches 59 and 61 aligned transversely across the end of strap end 38 thereby forming a box-stitch pattern 22. A further pair of stitches 62 extends diagonally across box-stitch 22 connecting the conners. Box stitch pattern 22 extends through fabric member 18, strap end 38, fabric member 40 and fabric wall 12, thereby fastly securing the above elements in place.

In the preferred embodiment of the present invention the fabric wall 12 backpack 10 is comprised of polyurethane foam 26 covered by a durable fabric 20 and 24. Box stitch pattern 22 extends through the polyurethane foam as well as the other elements of the present invention.

Fabric member 18 and 40 in conjunction with shoulder strap end 38, fabric wall 12 and box-stitch patterns 22 and 24 form a strong junction between shoulder strap 14 and backpack 10 which is capable of withstanding large amounts of stress over extended periods of use. The fabric member 40 reinforces strap end 38 and further provides a base material through which the stitching means may extend. Fabric member 18 and box-stitch 22 are used to securely fasten the strap end 38 against fabric wall 12. In the preferred embodiment, fabric member 18 can extend transversely across the width of fabric wall 12 thereby serving as one of the two fabric members required to attach both strap 14 and 16. The polyurethane foam base 26 of fabric wall 12 further serves as a base against which the strap end 38 and fabric members 18 and 40 are secured. Box-stitch pattern 24 provides and economical way of securing fabric member 20 to strap member 38 while box stitch member 22 further provides an economical means for securing shoulder strap end 38 and fabric member 40 between fabric member 18 and fabric wall 12 thereby forming a durable shoulder strap attachment to backpack 10.

In view of the foregoing it will be noted that variation may be made to the embodiment of the present invention without departing from the true spirit of the applicant's invention.

I claim:

1. In a backpack, means for securing one end of an elongated shoulder strap to a fabric wall of said backpack comprising;

first and second elongated flexible reinforcing fabric members positioned in orthogonal relation to one another with said first elongated flexible reinforcing fabric member on one side and said second elongated flexible reinforcing fabric member on the other side of said end of said elongated strap and with said first elongated flexible reinforcing fabric member longitudinally aligned with said shoulder strap and intermediate said second elongated flexible reinforcing fabric member and said fabric wall, a first stitching means extending through said fabric wall, said first elongated flexible reinforcing fabric member, said end of said strap and said second elongated flexible reinforcing fabric member to hold said elements securely together, and a second stitching means securing said first elongated flexible reinforcing fabric member to said strap.

2. In a carrying device, means of securing an end of a carrying strap to a fabric wall of said carrying device comprising;

first and second elongated flexible reinforcing fabric members positioned in orthogonal relation to one another with said first elongated flexible reinforcing fabric member disposed on a first side of said carrying strap and said second elongated flexible reinforcing fabric member disposed on a second side of said carrying strap and with said first elongated flexible reinforcing fabric member longitudinally aligned with said carrying strap and intermediate said second elongated flexible reinforcing fabric member and said fabric wall, a first stitching means extending through said fabric wall, a portion of said first elongated flexible reinforcing fabric member, said end of said strap and said second elongated flexible reinforced fabric member to hold said elements securely together, and a second stitching means securing said first elongated flexible reinforcing fabric member to said carrying strap.

3. The strap securing means of claim 1 or 2 wherein said elongated flexible reinforcing fabric members are comprised of nylon webbing.

4. The strap securing means of claim 1 or 2 wherein said fabric wall is reinforced with a polyurethane foam backing.

5. The strap securing means of claim 1 or 2 wherein said first stitching means is comprised of a pair of parallel stitches longitudinally aligned with the end of said strap and a second pair of parallel stitches latitudinally aligned with the end of said strap thereby forming a box-stitch pattern and further including a pair of diagonal stitches connecting corners of said box-stitch pattern.

6. The strap securing means of claim 5 wherein said first elongated flexible reinforcing fabric member is longitudinally attached to the end of said strap by a box-stitch pattern.

7. The strap securing means of claim 1 or 2 wherein said strap is further comprised of polyurethane foam covered with fabric.

8. The strap securing means of claim 1 or 2 wherein said first elongated flexible reinforcing fabric member is made of a different material than said second elongated flexible reinforcing fabric member.

* * * * *